US008687997B2

(12) United States Patent
Kurotsu et al.

(10) Patent No.: US 8,687,997 B2
(45) Date of Patent: Apr. 1, 2014

(54) IMAGE FORMING APPARATUS CONFIGURED TO DIRECT COOLING AIR FLOW TO A FIXING DEVICE ROLLER PROXIMATE THE OUTER SIDE OF THE APPARATUS MAIN BODY

(75) Inventors: Yoshihiko Kurotsu, Osaka (JP); Hironori Takahashi, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 203 days.

(21) Appl. No.: 13/290,453

(22) Filed: Nov. 7, 2011

(65) Prior Publication Data

US 2012/0114346 A1 May 10, 2012

(30) Foreign Application Priority Data

Nov. 8, 2010 (JP) ..... 2010-250005
Dec. 20, 2010 (JP) ..... 2010-282582

(51) Int. Cl.
*G03G 15/20* (2006.01)
*G03G 15/00* (2006.01)

(52) U.S. Cl.
USPC ..... 399/92; 399/67; 399/334

(58) Field of Classification Search
USPC ..... 399/92, 67, 69, 334
See application file for complete search history.

(56) References Cited

U.S. PATENT DOCUMENTS

| | | | | |
|---|---|---|---|---|
| 2007/0059022 | A1* | 3/2007 | Yamaoka et al. | 399/92 |
| 2007/0189798 | A1 | 8/2007 | Matsuno | 399/92 |
| 2009/0202268 | A1* | 8/2009 | Furukawa | 399/92 |
| 2011/0110678 | A1* | 5/2011 | Nishikawa | 399/92 |

FOREIGN PATENT DOCUMENTS

| | | | |
|---|---|---|---|
| JP | 2-158786 | | 6/1990 |
| JP | 2001-166622 | | 6/2001 |
| JP | 2001-290386 | | 10/2001 |
| JP | 2003-202765 | A | 7/2003 |
| JP | 2006-285151 | A | 10/2006 |
| JP | 2007-219032 | | 8/2007 |
| JP | 2008-52031 | | 3/2008 |
| JP | 2010-72399 | A | 4/2010 |

* cited by examiner

*Primary Examiner* — Sophia S Chen
(74) *Attorney, Agent, or Firm* — Smith, Gambrell & Russell, LLP

(57) ABSTRACT

An image forming apparatus includes a fixing device that has: a fixing roller heated by induction and a pressing roller brought into press-contact with the fixing roller to fix a toner image borne on a paper sheet conveyed toward the fixing device by a conveyor unit. When a paper sheet having a width smaller than a width of a maximum-width recording medium that can be passed through the fixing device is passed through the fixing device, a non-paper passing region is formed at each end portion of each of the fixing and pressing rollers. Sirocco fans cool the non-paper passing region at a part of an outer peripheral surface of the pressing roller. The pressing roller is disposed opposed to the outer side of the main body of the image forming apparatus.

17 Claims, 6 Drawing Sheets

IMAGE FORMING APPARATUS CONFIGURED TO DIRECT COOLING AIR FLOW TO A FIXING DEVICE ROLLER PROXIMATE THE OUTER SIDE OF THE APPARATUS MAIN BODY

BACKGROUND OF THE INVENTION

This application is based on Japanese Patent Application No. 2010-250005 filed on Nov. 8, 2010 and Japanese Patent Application No. 2010-282582 filed on Dec. 20, 2010, the contents of which are hereby incorporated by reference.

FIELD OF THE INVENTION

The present invention relates to an image forming apparatus including a fixing device and using an electrophotographic method, such as a copy machine, a printer, a facsimile, or a complex machine having functions of these apparatuses, and particularly relates to an image forming apparatus that performs cooling of a non-paper passing region of a fixing device.

DESCRIPTION OF RELATED ART

Conventionally, in a fixing device used in an electrophotographic image forming apparatus, a paper sheet on which a toner image is formed is fed into a nip between a fixing roller that is heated and a pressing roller, where the toner on the paper sheet is melted under a heating action by the fixing roller, and concurrently therewith, a pressing action is applied from the pressing roller to the toner image thus melted, so that the toner image is fixed on the paper sheet.

This conventional type of fixing device, however, has presented a problem that there occurs a temperature difference on the surface of the pressing roller. That is, during the warm-up of the fixing device, the fixing roller and the pressing roller are being stopped from rotating, and when the fixing roller becomes heated, the pressing roller is heated to a high temperature only at a portion thereof that is in contact with the fixing roller and stays at a low temperature at other portions thereof where a temperature is increased slowly. If, in this state, the fixing roller and the pressing roller are started to rotateat the time of image formation, until a predetermined temperature is reached, such a local temperature difference of the pressing roller adversely affects fixing processing, resulting in the occurrence of unevenness in fixing.

In order, therefore, to eliminate a local temperature difference of a pressing roller, in a known fixing device, a pressing roller is provided with a hollow portion open at both ends of the pressing roller in an axial direction, and a fan is further provided so that hot air from a heating roller is caused to flow from one end to the other end of the hollow portion of the pressing roller.

In the above-described fixing device, in a case where a paper sheet having a width smaller than a maximum paper sheet width handled in fixing processing is printed, there occurs a temperature difference between a paper passing region and a non-paper passing region. This is attributable to the fact that heat is consumed for fixing processing in the paper passing region through which a paper sheet is passed, whereas no heat is consumed in the non-paper passing region, which leads to an increasing temperature difference between the paper passing region and the non-paper passing region.

In order to eliminate such a temperature difference between a paper passing region and a non-paper passing region, in a known image forming apparatus, a fan is disposed in a conveyor unit that conveys a paper sheet toward a fixing device. In this image forming apparatus, three fans in total are disposed one by one at positions corresponding to a paper passing region in the middle and non-paper passing regions on both sides of the paper passing region, respectively, along the entire conveying width of the conveyor unit. In a case where fixing processing is performed with respect to a paper sheet having a maximum width, the three fans are made to rotate so that an area of the conveyor unit along the entire conveying width is cooled and so that the paper sheet is attracted onto the conveyor unit. On the other hand, in a case where fixing processing is performed with respect to a paper sheet having a width smaller than the maximum width, the two fans corresponding to the non-paper passing regions are made to rotate so as to prevent a temperature in the non-paper passing regions from being increased. Thus, each of a fixing roller and a pressing roller is maintained at a uniform surface temperature in an axial direction.

Furthermore, there is also known a configuration in which a duct is provided to cool roller end portions (non-paper passing regions). As an example of this, there is a configuration in which a fan and a duct bifurcated toward both end portions of a fixing roller are provided to uniformly cool the end portions of the fixing roller. As another example, there is also a configuration in which, in order to cool end portions of a fixing roller, a heat sink is provided, and outside air from a fan is delivered via a duct to the end portions of the fixing roller. As still another example, there is also a configuration in which, in performing fixing by induction heating, in order to suppress an excessive temperature increase in non-paper passing regions covered with a magnetic flux generating portion, cooling air is delivered via a duct into a clearance between a fixing roller and the magnetic flux generating portion.

In the configuration in which the fans are disposed in the conveyor unit, however, the fans, which are provided on an upstream side of the fixing device in a paper conveying direction, end up cooling mainly areas along a paper conveying path corresponding to the non-paper passing regions and, therefore, do not directly cool the fixing roller or the pressing roller, which has been problematic in that cooling efficiency is lowered. Furthermore, in the configuration in which the duct is provided to cool the roller end portions (non-paper passing regions), hot air generated as a result of cooling the fixing roller might remain in the apparatus main body, which has been problematic in that the fixing roller cannot be cooled efficiently.

SUMMARY OF THE INVENTION

In view of the above-described problems, it is an object of the present invention to provide an image forming apparatus that, even in a case of performing fixing processing with respect to a small-sized recording medium, efficiently eliminates a temperature difference between a paper passing region and a non-paper passing region of a fixing device.

In order to achieve the above-described object, an image forming apparatus according to a first aspect of the present invention includes: an image forming portion that forms a toner image on a recording medium; and a fixing device that is disposed on a downstream side of the image forming portion with respect to a direction in which a recording medium is conveyed, has: a fixing roller that is heated by a heating member; and a pressing roller that is brought into press-contact with the fixing roller to form a fixing nip, and passes a recording medium through the fixing nip to fix unfixed toner borne on the recording medium. In the image forming apparatus, a fan is provided that, when a recording medium having a width smaller than a width of a maximum-width recording medium that can be passed through the fixing nip is passed through the fixing nip, cools a part of an outer peripheral surface of a non-paper passing region formed on one of the fixing roller and the pressing roller, which is disposed in proximity to an outer side of a main body of the image forming apparatus, the part facing the outer side of the apparatus main body.

Still other objects of the present invention and specific advantages obtained by the present invention will be further clarified by the following description of embodiments.

DESCRIPTION OF PREFERRED EMBODIMENTS

Hereinafter, embodiments of the present invention will be described with reference to the appended drawings. The present invention, however, is not limited to the embodiments described herein. The intended use of the invention, terms used here, and so on are not limited to the following.

Figure 1:
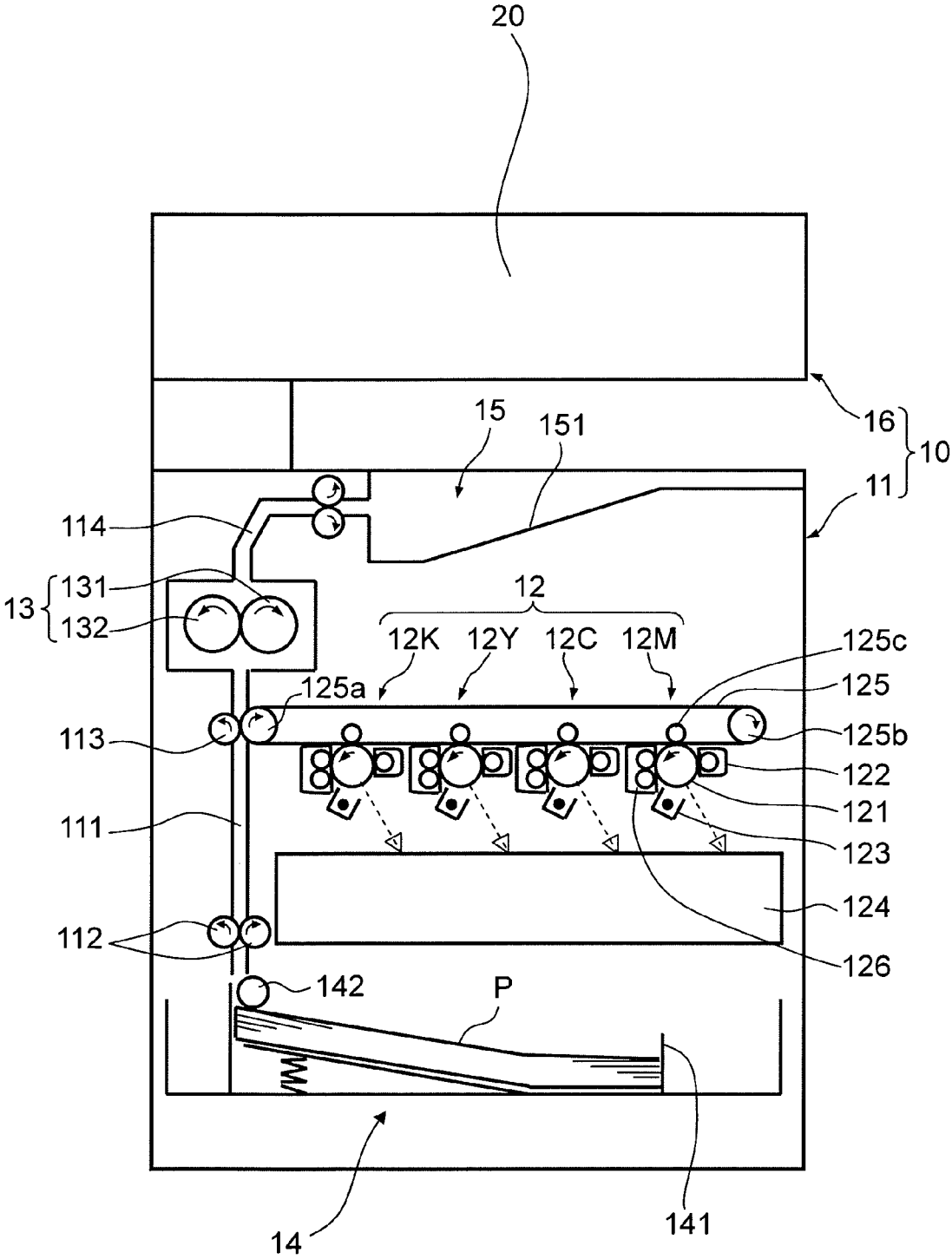
FIG. 1 is a cross-sectional view showing an image forming apparatus 10 according to one embodiment of the present invention.

FIG. 1 is a cross-sectional view showing an image forming apparatus according to an embodiment of the present invention. An image forming apparatus 10 is an in-body paper discharge type tandem color copy machine including a lower apparatus main body 11 and an upper apparatus main body 16.

In the lower apparatus main body 11, a paper feed portion 14, an image forming portion 12, and a fixing device 13 are provided, and in the upper apparatus main body 16, an image reading portion 20 that reads an image on an original document is provided. A paper discharge space 15 is formed between the lower apparatus main body 11 and the upper apparatus main body 16, and a paper sheet P after having been subjected to fixing processing is discharged into the paper discharge space 15.

The image forming portion 12 forms a toner image on the paper sheet P fed from the paper feed portion 14, and in the image forming portion 12, four image forming units, which are a magenta unit 12M, a cyan unit 12C, a yellow unit 12Y, and a black unit 12K,are provided in order from an upstream side toward a downstream side in a rotation direction of an intermediate transfer belt 125.

In each of these image forming units 12M, 12C, 12Y, and 12K, a photosensitive member121 that is an image bearing member is provided, and a development device 122, an exposure unit 124, a charger 123, and a cleaner 126 are provided around the photosensitive member121.

The development device 122 is disposed on the right of the photosensitive member 121 so as to be opposed thereto and supplies toner to the photosensitive member 121. The charger 123 is disposed on an upstream side of the development device 122 with respect to a photosensitive member rotation direction so as to be opposed to the surface of the photosensitive member 121 and charges the surface of the photosensitive member 121 in a uniform manner.

The exposure unit 124 is intended to scan the photosensitive member 121 for exposure based on image data such as characters and patterns read by the image reading portion 20 and is provided below the photosensitive member 121. In the exposure unit 124, there are provided a laser light source, a polygon mirror, and so on, which are not shown. Laser light emitted from the laser light source is applied to the surface of the photosensitive member 121 via the polygon mirror from a downstream side of the charger 123 in the photosensitive member rotation direction. The applied laser light is used to form an electrostatic latent image on the surface of the photosensitive member 121, and the electrostatic latent image thus formed is developed into a toner image by the development device 122.

The endless intermediate transfer belt 125 is laid in a tensioned condition over a drive roller 125*a* and a tension roller 125*b*. The drive roller 125*a* is driven to rotate by an unshown motor, and the intermediate transfer belt 125 is driven circularly by the rotation of the drive roller 125*a*.

The photosensitive members 121 are arranged below the intermediate transfer belt 125 so as to be in contact therewith along a conveying direction adjacently to each other. A primary transfer roller 125*c* is opposed to the photosensitive member 121 via the intermediate transfer belt 125 and comes into press-contact with the intermediate transfer belt 125 to form a primary transfer portion. At this primary transfer portion, in response to the rotation of the intermediate transfer belt 125, toner images on the photosensitive members 121 are successively transferred onto the intermediate transfer belt 125 at predetermined timing. The toner images of the four colors of magenta, cyan, yellow, and black are thus superposed on one another to form a toner image on the surface of the intermediate transfer belt 125.

A secondary transfer roller 113 is opposed to the drive roller 125*a* via the intermediate transfer belt 125 and comes into press-contact with the intermediate transfer belt 125 to form a secondary transfer portion. At this secondary transfer portion, the toner image on the surface of the intermediate transfer belt 125 is transferred onto the paper sheet P. After the transfer, an unshown belt cleaner cleans off toner remaining on the intermediate transfer belt 125.

In a lower portion of the image forming apparatus 10, the paper feed portion 14 is provided, and in the paper feed portion 14, a paper tray 141 is provided that stores the paper sheet P and is demountably mounted in the apparatus main body 11. On the left of the paper feed portion 14, a first paper conveying path 111 is provided along which the paper sheet P fed out from the paper tray 141 by a pick-up roller 142 is conveyed by conveying rollers 112 to the secondary transfer portion on the intermediate transfer belt 125. Moreover, in an upper left portion of the image forming apparatus 10, there are provided the fixing device 13 that performs fixing processing with respect to the paper sheet P on which the image has been formed and a second paper conveying path 114 along which the paper sheet that has been subjected to fixing processing is conveyed to a paper discharge tray 151.

The paper sheet P is conveyed to the secondary transfer portion in synchronization with the timing of an image forming operation on the intermediate transfer belt 125 and the timing of a paper feeding operation. Onto the paper sheet P conveyed to the secondary transfer portion, the toner image on the intermediate transfer belt 125 is secondarily transferred by the secondary transfer roller 113 to which a bias potential has been applied, and the paper sheet P is then conveyed to the fixing device 13.

The fixing device 13 includes a fixing roller 131 that is heated by a heat source and a pressing roller 132 provided so as to be in press-contact with the fixing roller 131 and performs fixing processing by applying heat and pressure to the paper sheet P onto which the toner image has been transferred. The paper sheet P on which the toner image has been fixed is discharged onto the paper discharge tray 151 by a pair of exit rollers via the second paper conveying path 114.

Figure 2:
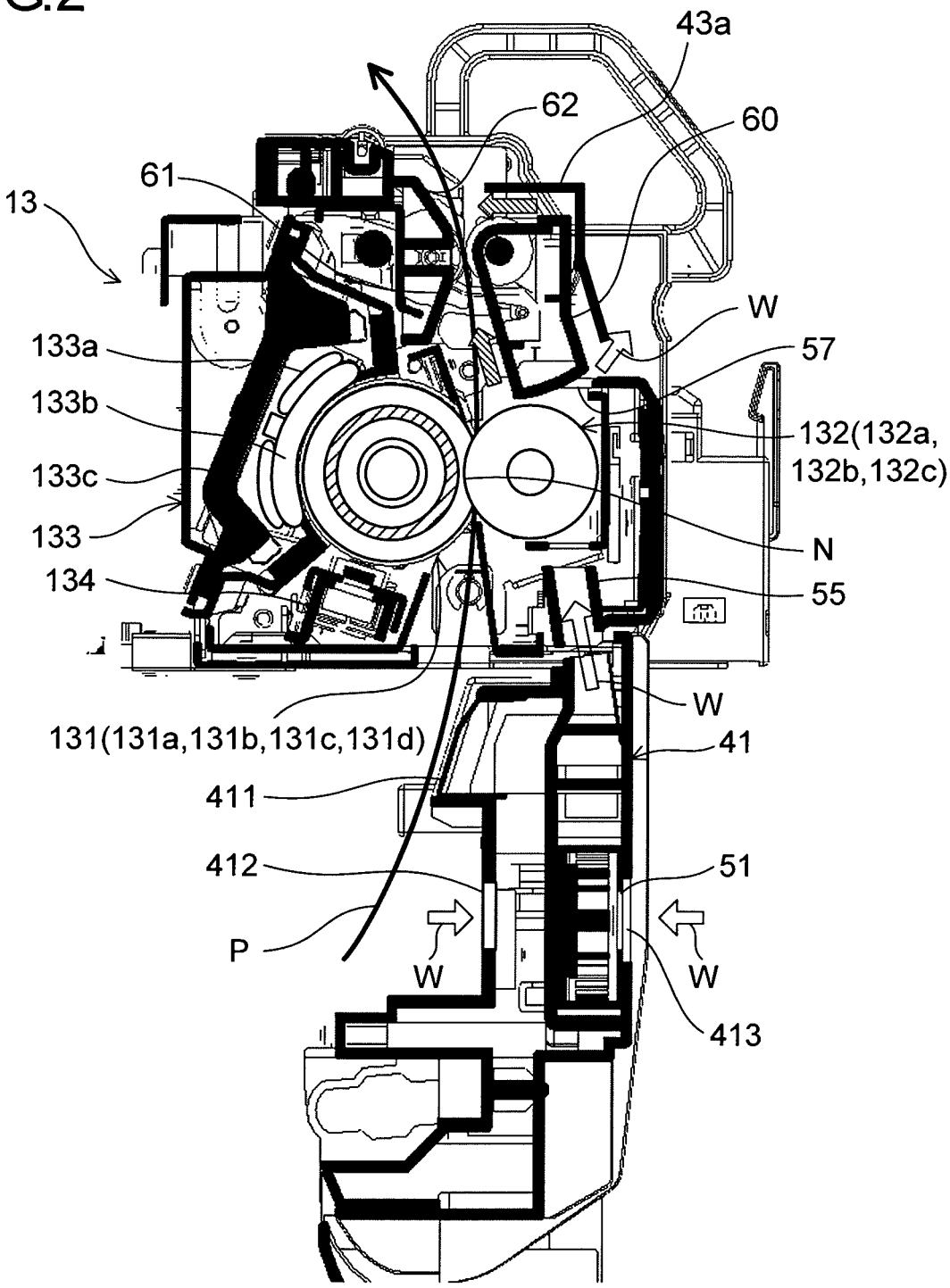
FIG. 2 is a cross-sectional view showing a fixing device 13 and a periphery thereof of an image forming apparatus 10 according to a first embodiment of the present invention.
Figure 3:
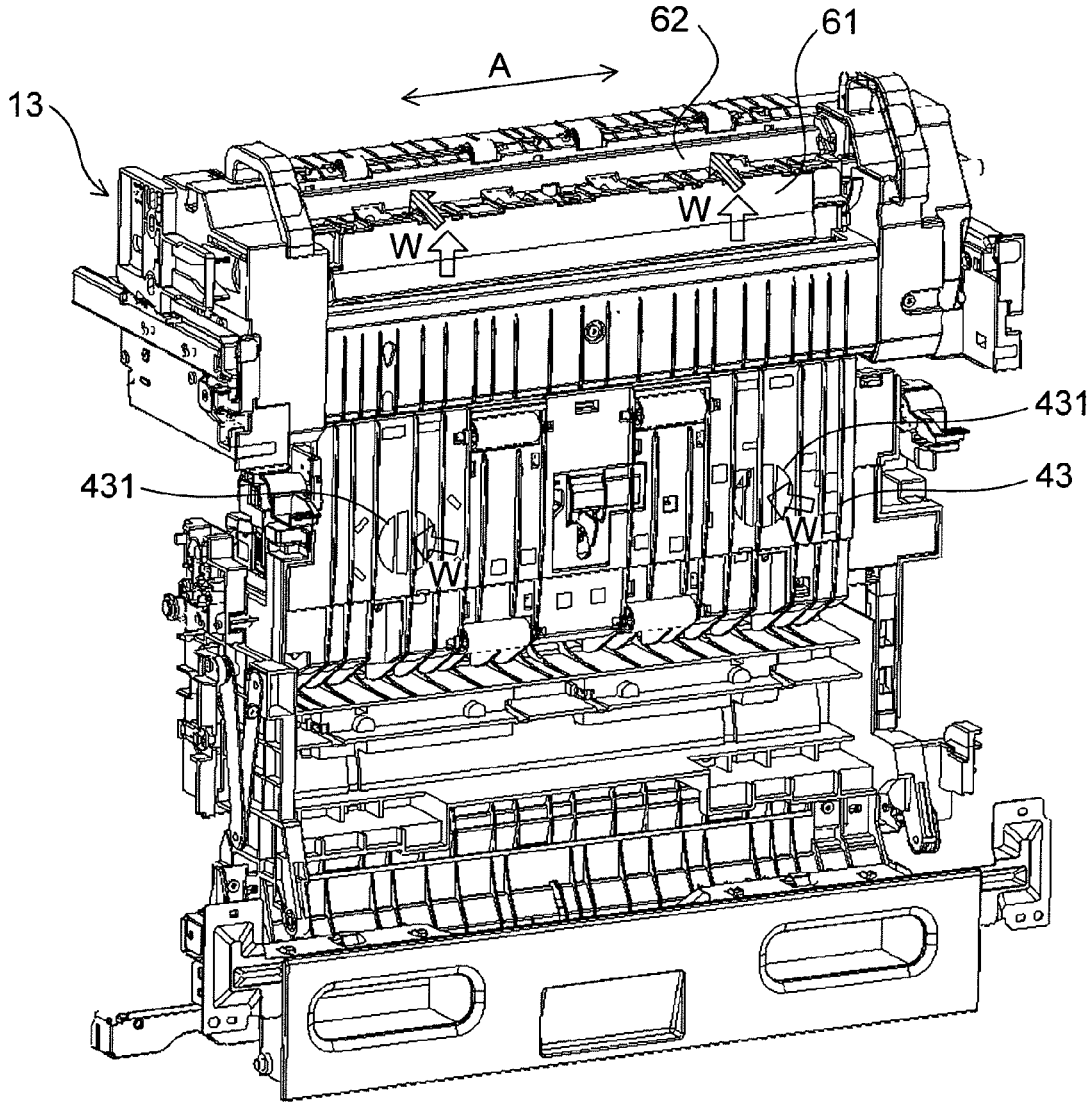
FIG. 3 is a perspective view of the fixing device 13 and the periphery thereof in the image forming apparatus 10 of the first embodiment as seen from the right side in FIG. 2.
Figure 4:
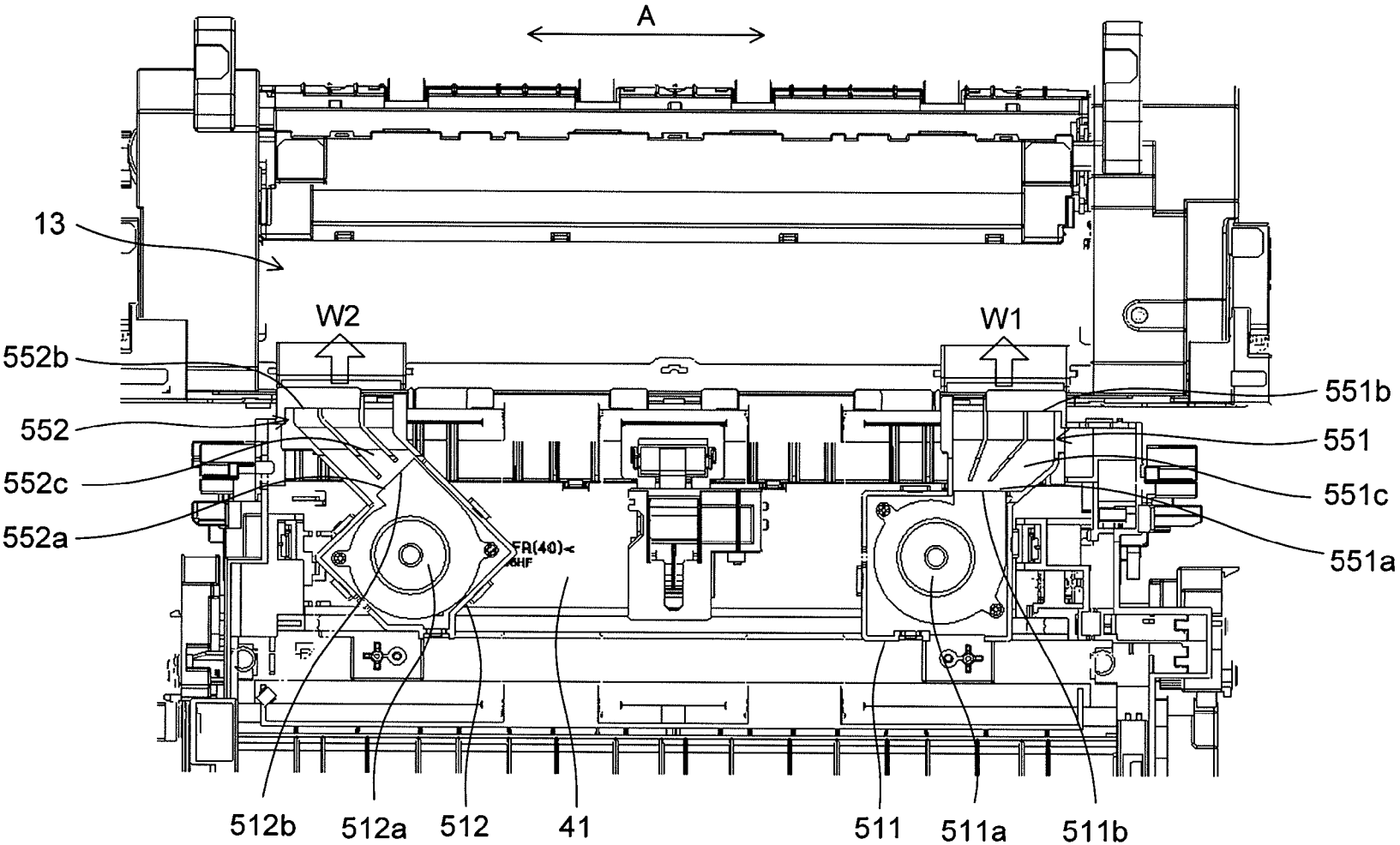
FIG. 4 is a plan view of the fixing device 13 and the periphery thereof in the image forming apparatus 10 of the first embodiment as seen from the right side in FIG. 2.

FIG. 2 is a cross-sectional view showing a fixing device and a periphery thereof of an image forming apparatus according to a first embodiment of the present invention, FIG. 3 is a perspective view of the fixing device and the periphery thereof of the image forming apparatus of the first embodiment as seen from an outer side of the main body of the image forming apparatus, and FIG. 4 is a plan view of the fixing device and the periphery thereof of the image forming apparatus of the first embodiment as seen from the outer side of the main body of the image forming apparatus. It is to be noted that FIG. 2 is a cross-sectional view showing the fixing device 13 as seen from the back side of FIG. 1, and the right side of FIG. 2 corresponds to an outer side of the main body 11 of the image forming apparatus. Furthermore, in FIG. 2, a solid arrow P indicates a direction in which the paper sheet P is conveyed, and a hollow arrow W and a hatched arrow indicate an air flowing direction.

Referring to FIG. 2, as described earlier, the fixing device 13 includes the fixing roller 131 and the pressing roller 132 and further includes, in addition thereto, an induction heating portion 133 and a temperature sensor 134. On the periphery of the fixing device 13, a conveyor unit 41, a sirocco fan 51, and an air guiding path 55 directed to the side of the fixing device 13 are provided.

The fixing device 13 adopts a heat roller fixing method using an electromagnetic induction heating type heat source and includes the induction heating portion 133 provided so as to be opposed to the outer periphery of the fixing roller 131 and the temperature sensor 134 that is a thermistor or the like and detects a temperature of the surface of the fixing roller 131. The induction heating portion 133 and the temperature sensor 134 are securely held to the apparatus main body 11, and the fixing roller 131 and the pressing roller 132, on the other hand, are held rotatably to the apparatus main body 11.

The fixing roller 131 includes a base member 131*a* that is a cylindrical stainless steel member and an elastic layer 131*d* made of silicone rubber sponge thereby to provide improved elasticity and mold releasability with respect to a nip N where the fixing roller 131 comes into press-contact with the pressing roller 132. Furthermore, the fixing roller 131 also includes, between the base member 131*a* and the elastic layer 131*d*, a heat insulation layer 131*b* and an induction heat generation layer 131*c*, which are provided in this order from the side of the base member.

The pressing roller 132 includes a base member 132*a* that is an aluminum core metal, an elastic layer 132*b* that is made of silicone rubber and formed on the base member 132*a* thereby to impart elasticity with respect to the nip N, and a mold release layer 132*c* that is a fluorine resin tube and covers the surface of the elastic layer thereby to provide improved mold releasability when an unfixed toner image is fixed by fusing at the nip N.

Furthermore, the pressing roller 132 is driven to rotate by a drive source (omitted in the figure) such as a motor and is pressed against the fixing roller 131 toward the direction of the center of the fixing roller 131. Thus, the pressing roller 132 comes into press-contact with the fixing roller 131, and rotating the pressing roller 132 drives the fixing roller 131 to rotate so that opposed parts of the respective surfaces of the pressing roller 132 and the fixing roller 131 move in the same direction at the nip N.

The temperature sensor 134 is disposed so as to be opposed to each of a middle portion of the surface of the fixing roller 131 in an axial direction (width direction), which is a paper passing region, and both end portions thereof in the axial direction, which are left unused as non-paper passing regions when a small-sized or vertical A4-size paper sheet is passed, and detects a temperature at each of these regions. Based on a temperature detected by the temperature sensor 134, power supply to the induction heating portion 133 is controlled so that the surface of the fixing roller 131 is maintained at a predetermined temperature.

The induction heating portion 133 includes an excitation coil 133*a*, a bobbin 133*b*, and a core 133*c* and heats the fixing roller 131 by electromagnetic induction. The induction heating portion 133 extends in the axial direction of the fixing roller 131 and is disposed so as to be opposed to the fixing roller 131 in such a manner as to surround a part of the outer periphery thereof.

The excitation coil 133*a* made of copper wire is wound on the bobbin 133*b* and provided in a spiral shape across a part of the outer periphery of the fixing roller 131 so as to circle around a middle portion of the core 133*c* in an axial direction. Furthermore, the excitation coil 133*a* is connected to an unshown power source and generates a magnetic flux based on a high-frequency current supplied from the power source. A magnetic flux generated from the induction heating portion 133 is emitted in a direction parallel to the plane of FIG. 2 and penetrates through the induction heat generation layer 131*c* of the fixing roller 131. An eddy current is generated around the magnetic flux in the induction heat generation layer 131*c*, and when the eddy current flows, Joule heat is generated due to electrical resistance in the induction heat generation layer 131*c* to cause the induction heat generation layer 131 c to generate heat.

Based on a temperature detected by the temperature sensor 134, power of the power source is controlled so that the fixing roller 131 is heated to a predetermined temperature by the induction heating portion 133. When the fixing roller 131 becomes heated to a predetermined temperature, the paper sheet P being sandwiched at the nip N is heated, at which time the paper sheet P is also pressed by the pressing roller 132, and thus the toner in a powder state on the paper sheet P is fixed by fusing.

The conveyor unit 41 conveys the paper sheet P onto which the toner image has been secondarily transferred by the secondary transfer roller 113 (see FIG. 1) toward the fixing device 13, and in the conveyor unit 41, a paper guiding surface 411 and air introduction portions 412 and 413 are formed. Furthermore, the sirocco fan 51 is provided in the conveyor unit 41.

The paper guiding surface 411 is formed at an angle so as to guide the paper sheet P toward the nip N of the fixing device 13. The first air introduction portion 412 is formed below the paper guiding surface 411, and the second air introduction portion 413 is formed at a position on the opposite side of the first air introduction portion 412 so as to be opposed thereto. The first and second air introduction portions 412 and 413 are openings for air to flow there through. The sirocco fan 51 is disposed between the first and second air introduction portions 412 and 413, and rotating the sirocco fan 51 allows an air flow W to be taken into the sirocco fan 51 through the first and second air introduction portions 412 and 413.

The sirocco fan 51 is a fan configured so that a plurality of blades thereof extending in its radial direction are rotated to cause air sucked from a center portion thereof to be blown out through a blow-out port provided at an outer peripheral portion thereof along its outer peripheral edge. Consequently, rotating the blades of the sirocco fan 51 causes the air flow W sucked through the first and second air introduction portions 412 and 413 of the conveyor unit 41 to be blown out from an upper part of the conveyor unit 41. The air guiding path 55 is provided above the conveyor unit 41.

The air guiding path 55 is a duct open on upper and lower sides thereof, and an opening thereof on the lower side is in contact with the blow-out port of the sirocco fan 51, while an opening thereof on the upper side is disposed so as to be opposed to the pressing roller 132. More specifically, the upper side opening of the air guiding path 55 is opposed to the pressing roller 132 so as to face a part of the outer peripheral surface thereof on the right side relative to a rotation center axis of the pressing roller 132. Thus, the air flow W blown out from the sirocco fan 51 flows through the air guiding path 55 to be blown onto the right side part of the outer peripheral surface of the pressing roller 132. Consequently, the outer peripheral surface of the pressing roller 132 heated by fixing processing is cooled by the airflow W blown out from the sirocco fan 51. Hot air generated as a result of the cooling is discharged to the outside of the fixing device 13 through an air discharge opening 57 provided in the fixing device 13.

On the right side of the fixing device 13 and the conveyor unit 41 shown in FIG. 2 (outer side of the apparatus main body 11), a reversing conveyor unit 43 shown in FIG. 3 is provided, and hot air W that has been discharged to the outside of the fixing device 13 is discharged to the outside of the apparatus main body 11 from an upper part of the reversing conveyor unit 43. The reversing conveyor unit 43 is provided between the conveyor unit 41 and an external appearance cover member (omitted in the figure) constituting a part of the apparatus main body 11. In a case where, with respect to the paper sheet P on one side of which the image has been formed, an image is to be formed also on the other side thereof, the reversing conveyor unit 43 turns over the paper sheet P and conveys it to the secondary transfer portion.

The reversing conveyor unit 43 has a pair of third air introduction portions 431. The third air introduction portions 431 are openings for outside air to flow there through and are formed at positions corresponding to both end portion sides of the fixing device 13 in a width direction A. At each of positions opposed to the pair of third air introduction portions 431, the above-described second air introduction portion 413 (see FIG. 2) of the conveyor unit 41 is provided, so that outside air flows to the second air introduction portion 413 through each of the third air introduction portions 431 to be taken into the sirocco fan 51.

Referring to FIG. 4, the following describes in detail how the sirocco fan 51 is arranged in the width direction A. FIG. 4 is a plan view showing a state where the reversing conveyor unit 43 shown in FIG. 3 is removed.

A pair of sirocco fans 51 is provided at positions opposed to the pair of third air introduction portions 431 (see FIG. 3) of the reversing conveyor unit 43. Furthermore, the air guiding path 55 (see FIG. 2) is provided so as to be opposed to each of the sirocco fans 51. As the sirocco fans 51, sirocco fans having the same configuration and function are used, and the sirocco fans 51 are mounted to the conveyor unit 41 asymmetrically to each other, As shown in FIG, 4, for the sake of explaining the arrangement of the sirocco fans 51, the sirocco fans are designated as a first sirocco fan 511 and a second sirocco fan 512, respectively. Furthermore, for the sake of explaining the arrangement and structures of the air guiding paths 55, the air guiding paths 55 are also designated as a first air guiding path 551 and a second air guiding path 552, respectively.

The first sirocco fan 511 includes an inflow portion 511*a* that takes air into the center portion of the first sirocco fan 511, a blow-out port 511*b* through which air is blown out to the outside, and blades (omitted in the figure) used to deliver air taken in from the inflow portion 511*a* to the blow-out portion 511*b*. The second sirocco fan 512 also includes an inflow portion 512*a*, a blow-out port 512*b*, and blades (omitted in the figure) that are similar in configuration and function to those of the first sirocco fan 511.

The first air guiding path 551 has a lower side opening portion 551*a*, an upper side opening portion 551*b*, and a communicating portion 551*c* through which air flows between the lower side opening portion 551*a* and the upper side opening portion 551*b*. Furthermore, the second air guiding path 552 has a lower side opening portion 552*a*, an upper side opening portion 552*b*, and a communicating portion 552*c* through which air flows between the lower side opening portion 552*a* and the upper side opening portion 552*b*.

The first sirocco fan 511 is disposed so that the blow-out port 511*b* thereof faces the upper side in a direction perpendicular to the width direction A, and the first air guiding path 551 is disposed on the upper side of the first sirocco fan 511. The lower side opening portion 551*a* of the first air guiding path 551 is in contact with the blow-out port 511*b*, and the upper side opening portion 551*b* of the first air guiding path 551 is opposed to the non-paper passing region on the right side of FIG. 4 and has an opening having a length corresponding to the width of the non-paper passing region and a predetermined length in the depth direction. The communicating portion 551*c* is formed so as to be bent to a lower left side as seen from the upper side opening portion 551*b*. Consequently, an air flow W1 blown out from the first sirocco fan 511 cools substantially the entire area of the right side non-paper passing region of the fixing device 13 from the upper side opening portion 551*b* via the communicating portion 551*c* of the first air guiding path 551.

On the other hand, in order that substantially the same volume of air as that of the air delivered to the above-described right side non-paper passing region is delivered in a spreading manner also to the non-paper passing region on the left side of FIG. 4, the upper side opening portion 552*b* of the second air guiding path 552 is opposed to the left side non-paper passing region and has an opening having the same length in the width direction A as that of the opening of the upper side opening portion 551*b* of the first air guiding path 551 and the same area as that of the opening of the upper side opening portion 551*b* of the first air guiding path 551.

Furthermore, in order that the communicating portion 552*c* of the second air guiding path 552 has substantially the same length as that of the communicating portion 551 c of the first air guiding path 551, the communicating portion 552*c* is formed so as to be bent to a lower right side from the upper side opening portion 552*b*, and the second sirocco fan 512 is mounted to the conveyor unit 41 asymmetrically to the first sirocco fan 511. That is, the second sirocco fan 512 is mounted to the conveyor unit 41 so as to be disposed at a position rotated substantially 45° in a clockwise direction with respect to the first sirocco fan 511. Mounting the second sirocco fan 512 in this manner allows the communicating portion 551*c* of the first air guiding path 551 and the communicating portion 552*c* of the second air guiding path 552 to have substantially the same length. Moreover, even though the first and second sirocco fans 511 and 512 have the same configuration and function, air can be delivered from the second sirocco fan 512 to the non-paper passing region positioned on the left end portion side in the width direction A. At this time, it is not required that the second sirocco fan 512 in which the blow-out port 512*b* is positioned on the right side be disposed to stick out to the left side in the width direction A from the conveyor unit 41.

With the second sirocco fan 512 mounted so as to be disposed as described above, the lower side opening portion 552*a* of the second air guiding path 552 comes into contact with the blow-out port 512*b* of the second sirocco fan 512. An air flow W2 blown out from the second sirocco fan 512 cools substantially the entire area of the left side non-paper passing region of the fixing device 13 from the upper side opening portion 552*b* via the communicating portion 552*c* of the second air guiding path 552 at substantially the same flow rate as that of the air flow W1 in the right side non-paper passing region.

According to the above-described embodiment, the image forming apparatus 10 includes the fixing device 13 and the conveyor unit 41. The fixing device 13 has the fixing roller 131 that is heated and the pressing roller 132 that is brought into press-contact with the fixing roller 131 and fixes a toner image on the paper sheet P. The conveyor unit 41 conveys the paper sheet P toward the fixing device 13. When the paper sheet P having a width smaller than that of a maximum-width recording medium that can be passed through the fixing device 13 is passed through the fixing device 13, the non-paper passing regions are formed at both the end portions of each of the fixing roller 131 and the pressing roller 132, and the fans 511 and 512 are provided that cool the non-paper passing regions on the outer peripheral surface of the pressing roller 132.

According to this configuration, the paper sheet P bearing a toner image thereon is heated by the fixing roller 131 and pressed by the pressing roller 132, so that the toner image is fixed on the paper sheet P. When the paper sheet P having a small width is subjected to fixing processing, the two sirocco fans 511 and 512 provided in the conveyor unit 41 cool the non-paper passing regions on the outer peripheral surface of the pressing roller 132. When the non-paper passing regions of the pressing roller 132 are cooled, the non-paper passing regions of the fixing roller 131 being in press-contact with the pressing roller 132 are also cooled. Consequently, a temperature difference between the paper passing region and the non-paper passing regions can be eliminated efficiently.

Furthermore, according to the above-described embodiment, with respect to the pressing roller 132 disposed so as to be opposed to the outer side of the apparatus main body 11, the sirocco fans 511 and 512 are disposed so that air delivery to a part of the outer peripheral surface of the pressing roller 132, which faces the outer side of the apparatus main body 11, is facilitated. This makes it easy to discharge heat of the pressing roller 132 to the outside of the apparatus main body 11.

Furthermore, according to the above-described embodiment, the fans 511 and 512 are a pair of sirocco fans each configured so that a plurality of blades thereof extending in a radial direction are rotated to cause air sucked from the center portion thereof to be blown out through the blow-out port provided at the outer peripheral portion thereof along its outer peripheral edge. By the use of sirocco fans configured as above, cooling air is prevented from being diffused and can be easily formed into a flow directed to each of the non-paper passing regions, and a stable air volume is obtained, so that a temperature difference between the paper passing region and the non-paper passing regions can be eliminated efficiently.

Furthermore, according to the above-described embodiment, the image forming apparatus 10 further includes the first air guiding path 551 that establishes communication between the blow-out port 511*b* of the first sirocco fan 511 and one of the non-paper passing regions and the second air guiding path 552 that establishes communication between the blow-out port 512*b* of the second sirocco fan 512 and the other of the non-paper passing regions. The first and second sirocco fans 511 and 512 are designed to blow out air in the same direction through the blow-out ports 511*b* and 512*b*, respectively, and are mounted to the conveyor unit 41 so that the blow-out port 512*b* of the second sirocco fan 512 is displaced by a predetermined angle with respect to the blow-out port 511*b* of the first sirocco fan 511. The communicating portion 551*c* of the first air guiding path 551 and the communicating portion 552*c* of the second air guiding path 552 are thus made to have substantially the same length.

Thus, as the first and second sirocco fans 511 and 512, sirocco fans having the same configuration and function can be used, which saves time and effort in preparing sirocco fans and components related thereto and also eliminates the need for component inspections, thereby allowing cost reduction to be achieved. Moreover, with the first and second air guiding paths 551 and 552 having substantially the same length, the same volume of air is delivered to each of the non-paper passing regions, and thus the two non-paper passing regions can be cooled uniformly.

Furthermore, according to the above-described embodiment, the fixing device 13 further includes the induction heating portion 133 that is disposed so as to be opposed to the fixing roller 131 and, using a magnetic flux it generates, heats the induction heat generation layer 131*c* provided in the fixing roller 131 by induction heating, and the pressing roller 132 is cooled by the fans 511 and 512. Thus, in the electromagnetic induction heating type fixing device 13 including the induction heating portion 133, peripheral members such as the induction heating portion 133 and the temperature sensor 134 can be disposed appropriately, and a temperature difference between the paper passing region and the non-paper passing regions can be eliminated efficiently.

The above-described embodiment shows a configuration in which, when the paper sheet P having a width smaller than a maximum width is passed through the fixing device 13, cooling air of the first and second sirocco fans 511 and 512 is delivered to the non-paper passing regions. The present invention, however, is not limited thereto and may have a configuration in which, also when the paper sheet P having the maximum width is passed through the fixing device 13, cooling air of the first and second sirocco fans 511 and 512 is delivered to the non-paper passing regions. With this configuration, air is taken into the first and second sirocco fans 511 and 512 through the first air introduction portions 412 of the conveyor unit 41 corresponding thereto, respectively, and is used to attract the paper sheet P onto the paper guiding surface 411 of the conveyor unit 41, and thus the paper sheet P is guided properly and stably by the paper guiding surface 411. Furthermore, air is taken into the first and second sirocco fans 511 and 512 through the second air introduction portions 413 of the conveyor unit 41 corresponding thereto, respectively, and is used to attract the paper sheet P onto a paper guiding surface of the reversing conveyor unit 43, and thus the paper sheet P is guided properly and stably by the paper guiding surface.

By the way, in a case where the image forming apparatus 10 is used in a low temperature environment and printing is, therefore, started in a state where the apparatus main body 11 is cold (a cold start), moisture originally contained in the paper sheet P and evaporated there from when the paper sheet P passes through the nip N (see FIG. 2) between the fixing roller 131 and the pressing roller 132 may adhere in the form of dew condensation to conveying guides, etc. on a downstream side of the fixing device 13. Particularly in a case of performing printing with respect to both the sides of the paper sheet P, the paper sheet P in a state where a tip end thereof is still wet is conveyed again to the secondary transfer portion, which has been a cause of a problem that there occurs an image failure such as image deletion or a black stripe.

Among the conveying guides on the downstream side of the fixing device 13 shown in FIG. 2, a first conveying guide 60 and a second conveying guide 61, which are provided in proximity to the fixing device 13, are warmed up rapidly by heat of the fixing roller 131, and thus no dew condensation is generated thereon. On the other hand, a third conveying guide 62 is at a position distant from the fixing device 13 (on a downstream side of the nip N with respect to a paper conveying direction) and close to the outside of the apparatus main body 11 (paper discharge space 15), and thus dew condensation is likely to be generated thereon.

In the fixing device 13 of this embodiment, a part of the air flow W (hollow arrow in FIG. 2) blown onto the outer peripheral surface of the pressing roller 132 from the sirocco fan 51 (first and second sirocco fans 511 and 512) via each of the first air guiding path 551 and the second air guiding path 552 is led, without being discharged to the outside of the fixing device 13 through the air discharge opening 57, into a paper conveying path between the first conveying guide 60 and the second conveying guide 61 and into a clearance between the first conveying guide 60 and an inner side surface 43*a* of the reversing conveyor unit 43 (see FIG. 3). Then, the part of the air flow W is blown onto the surface of the third conveying guide 62 that supports a surface of the paper sheet P that has passed through the nip N, the surface facing the inner side of the main body of the image forming apparatus 10, and guides the paper sheet P to the outside of the image forming apparatus 10 (shown in FIGS. 2 and 3 by the hatched arrow).

By this configuration, the air flow W blown onto the outer peripheral surface of the pressing roller 132 cools each of the non-paper passing regions of the pressing roller 132 and is warmed up by heat of the pressing roller 132. The air flow W then reaches the surface of the third conveying guide 62 to cause water vapor present at the periphery of the third conveying guide 62 to be discharged to the outside. Furthermore, in a case where dew condensation has been generated on the surface of the third conveying guide 62, due to the warmed-up air flow, the dew condensation turns back into water vapor and is then evaporated.

Consequently, the sirocco fan 51 intended to cool each of the non-paper passing regions on the outer peripheral surface of the pressing roller 132 can be used also as a fan for dew condensation prevention. As a result, without the need to attach a dew condensation prevention member such as a non-woven fabric to the surface of the third conveying guide 62 or the need to separately provide a heater, the generation of dew condensation on the surface of the third conveying guide 62 is prevented effectively. Moreover, dew condensation generated can be eliminated rapidly.

In the case where the sirocco fan 51 is used also as a fan for dew condensation prevention, when a small-sized paper sheet (for example, a B5-size or smaller paper sheet) is passed, the sirocco fan 51 is made to rotate continuously from the start of printing so that both the end portions (non-paper passing regions) of the pressing roller 132 are cooled and so that the generation of dew condensation on the surface of the third conveying guide 62 is prevented. Furthermore, after a lapse of a given or longer time period from the start of rotation of the sirocco fan 51, a temperature of the third conveying guide 62 has been increased, so that dew condensation is no longer generated. Even so, since the non-paper passing regions of the pressing roller 132 need to continue to be cooled, the sirocco fan 51 is made to rotate continuously till the end of the printing.

On the other hand, when a large-sized paper sheet (for example, an A4-size or larger paper sheet) is passed, non-paper passing regions are not formed on the pressing roller 132, so that there is no need to cool both the end portions of the pressing roller 132. Thus, preferably, in this case, by using a reduced volume of air of the sirocco fan 51 compared with an air volume used when a small-sized paper sheet is passed, a temperature decrease at both the end portions of the pressing roller 132 is suppressed. The volume of air of the sirocco fan 51 is reduced by, for example, decreasing the rpm of the sirocco fan 51 or making the sirocco fan 51 rotate intermittently without changing the rpm of the sirocco fan 51. Furthermore, since dew condensation is no longer generated when the third conveying guide 62 is at an increased temperature, the rotation of the sirocco fan 51 is stopped after a lapse of a given time period. This can suppress a temperature decrease at both the end portions of the pressing roller 132 and can also suppress unnecessary power consumption.

Figure 5:
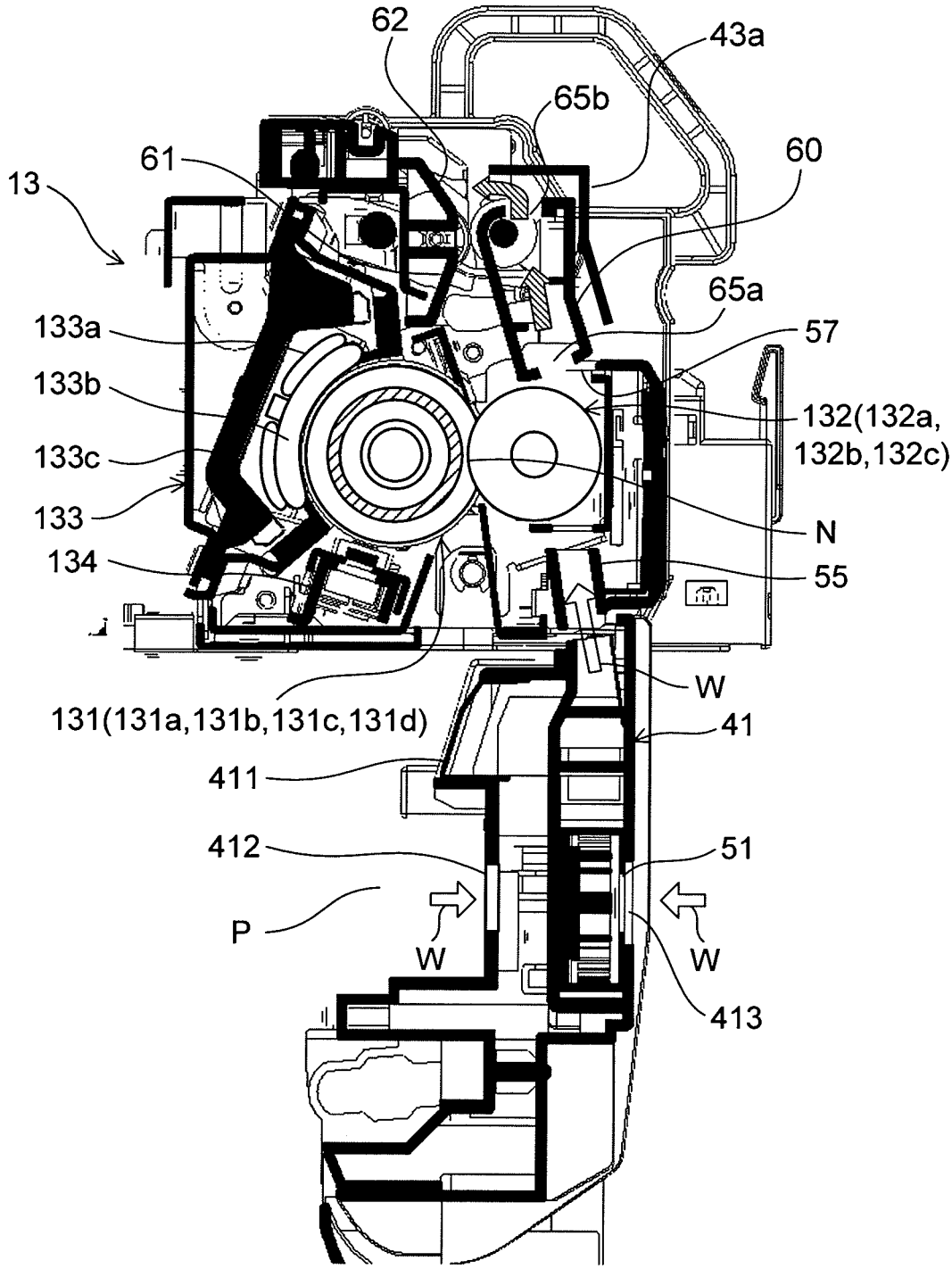
FIG. 5 is a cross-sectional view showing a fixing device 13 and a periphery thereof of an image forming apparatus 10 according to a second embodiment of the present invention.
Figure 6:
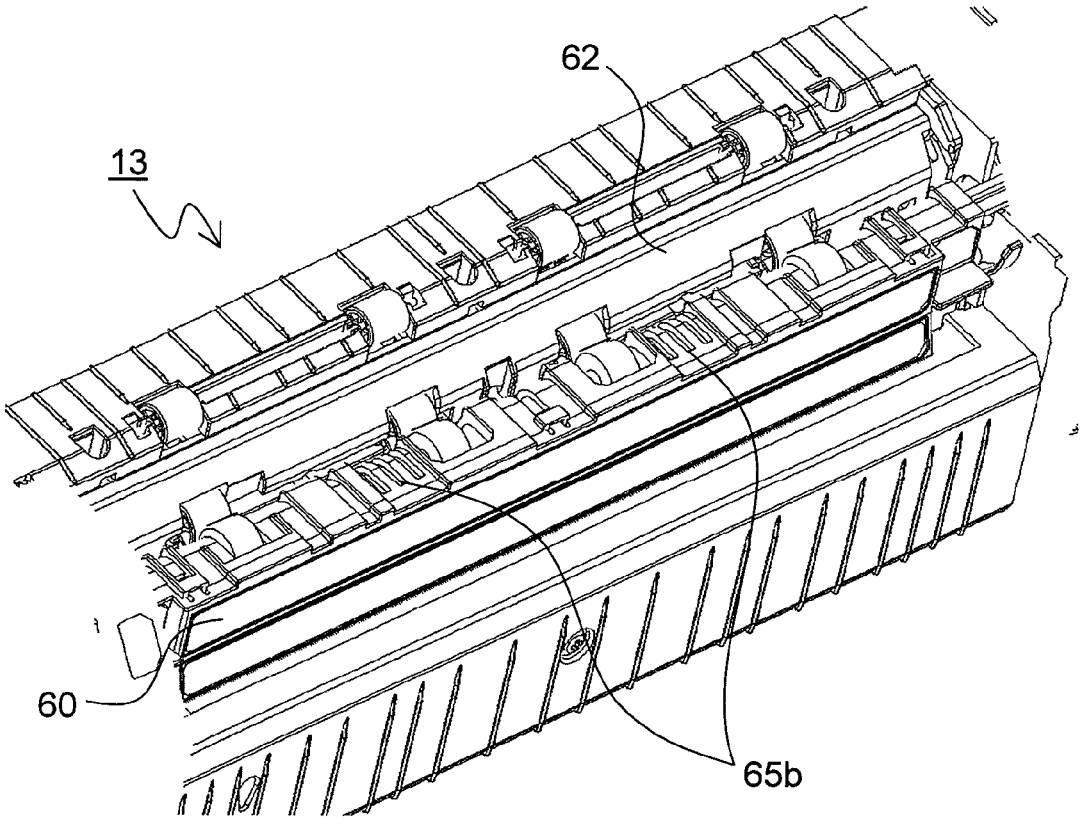
FIG. 6 is a perspective view of the fixing device 13 in the image forming apparatus 10 of the second embodiment as seen from above.

FIG. 5 is a cross-sectional view showing a fixing device and a periphery thereof of an image forming apparatus according to a second embodiment of the present invention. FIG. 6 is a perspective view of the fixing device in the image forming apparatus of the second embodiment as seen from above. In this embodiment, a first air passing opening 65*a* and a second air passing opening 65*b* are provided in a first conveying guide 60 positioned on a downstream side of a fixing device 13 in immediate proximity thereto with respect to a paper conveying direction. Other portions are configured similarly to those in the first embodiment, descriptions of which are, therefore, omitted.

According to the configuration of this embodiment, the first air passing opening 65*a* and the second air passing opening 65*b* are provided in the first conveying guide 60 disposed between a pressing roller 132 and a third conveying guide 62, so that an air passage is formed along which an air flow warmed up by the pressing roller 132 reaches the third conveying guide 62. Consequently, an air flow from a sirocco fan 51 can be led reliably to the surface of the third conveying guide 62, and thus compared with the first embodiment, the generation of dew condensation on the surface of the third conveying guide 62 can be prevented more efficiently.

Furthermore, as shown in FIG. 6, the second air passing opening 65*b* positioned on an upstream side of the third conveying guide 62 in immediate proximity thereto with respect to an air passing direction (direction indicated by a hatched arrow in FIG. 5) is provided at each of two locations opposed to substantially a middle portion of the third conveying guide 62 in a longitudinal direction. Thus, an air flow that has passed through the second air passing opening 65*b* is blown onto substantially the middle portion of the third conveying guide 62 in the longitudinal direction. On the other hand, similarly to the first embodiment, an air flow led into a paper conveying path between the first conveying guide 60 and a second conveying guide 61 and into a clearance between the first conveying guide 60 and an inner side surface 43*a* of a reversing conveyor unit 43 (see FIG. 3) is blown onto each of both end portions of the third conveying guide 62 in the longitudinal direction.

That is, the generation of dew condensation can be suppressed effectively not only at both the end portions of the third conveying guide 62 in the longitudinal direction but also at substantially the middle portion thereof in the longitudinal direction. The rotation control of the sirocco fan 51 at the time of passing a small-sized paper sheet and the rotation control thereof at the time of passing a large-sized paper sheet are similar to those in the first embodiment, descriptions of which are, therefore, omitted.

In addition to the above, the present invention is not limited to the foregoing embodiments and can be variously changed without departing from the spirit of the present invention. For example, although each of the foregoing embodiments shows an example in which the present invention is applied to the electromagnetic induction heating type fixing device 13, the present invention is not limited thereto and may instead be applied to a case in which a heater is provided in a fixing roller to heat the fixing roller or to a case in which a fixing belt is laid in a tensioned condition over a fixing roller and a heat roller so that the fixing roller is heated via the fixing belt.

Furthermore, although each of the foregoing embodiments shows a configuration in which cooling air of the sirocco fan 51 is delivered to the pressing roller 132, the present invention is not limited thereto and may instead have a configuration in which cooling air of the sirocco fan 51 is delivered to the outer peripheral surface of the fixing roller 131. Furthermore, the present invention may instead be applied to a case where, in a configuration in which a soaking roller that comes into press-contact with the pressing roller 132 is provided to dissipate heat of the pressing roller 132 so that a temperature difference between the paper passing region and the non-paper passing regions is eliminated, the outer peripheral surface of the soaking roller is cooled using the sirocco fan 51. Also in this case, effects similar to those provided by the foregoing embodiments are obtained.

Furthermore, although each of the foregoing embodiments shows a configuration using the sirocco fan 51, the present invention is not limited thereto and may instead have a configuration in which a propeller fan is used to deliver air to the outer peripheral surface of one of the fixing roller 131 and the pressing roller 132 or to suck in air. Also in either of these cases, effects similar to those provided by the foregoing embodiments are obtained.

Furthermore, each of the foregoing embodiments shows a configuration in which cooling air of the sirocco fan 51 is delivered to each of the non-paper passing regions. In this configuration, the volume of air of the fan may be controlled to vary depending on the type (a width, a thickness) of a small-sized paper sheet. Hereinafter, the effects of the present invention will be more specifically described by way of working examples.

WORKING EXAMPLES

The dew condensation prevention effect provided by the image forming apparatus of the present invention was evaluated in the following manner. That is, a tandem color copy machine (manufactured by Kyocera Mita Corporation) as shown in FIG. 1 was installed in an environment where dew condensation was likely to be generated (machine's external temperature: 25° C., machine's internal temperature: 10° C., machine's external humidity: 70%). With respect to each of a case where, with no air passing openings provided in the first conveying guide 60 as in the first embodiment, the sirocco fan 51 was started to rotate concurrently with the start of printing (Working Example 1), a case where, with the air passing openings 65*a* and 65*b* provided in the first conveying guide 60 as in the second embodiment, the sirocco fan 51 was started to rotate intermittently concurrently with the start of printing so as to have an air volume reduced to half (Working Example 2), and a case where the sirocco fan 51 was not made to rotate (Comparative Example), continuous printing of 30 paper sheets (A4-size standard paper sheets) after having been left to stand around the clock under a normal temperature and normal humidity environment (25° C., 65% RH) was performed, and adhesion of water droplets to the paper sheets discharged and to the third conveying guide 62 was visually observed.

As a result, in Working Example 1 of the present invention in which, with no air passing openings provided in the first conveying guide 60, the sirocco fan 51 was made to rotate, no water droplets adhered to the paper sheets discharged, whereas dew condensation was generated in the vicinity of the middle of the third conveying guide 62. Furthermore, in Working Example 2 of the present invention in which, with the air passing openings 65*a* and 65*b* provided in the first conveying guide 60, the sirocco fan 51 was made to rotate so as to have an air volume reduced to half, similarly to Working Example 1 of the present invention, no water droplets adhered to the paper sheets discharged. Furthermore, in this case, an air flow from the sirocco fan 51 was blown also onto the vicinity of the middle of the third conveying guide 62, so that dew condensation (a water droplet) generated in the vicinity of the middle of the third conveying guide 62 had a smaller size compared with that in Working Example 1 of the present invention.

In contrast, in Comparative Example in which the sirocco fan 51 was not made to rotate, as printing progressed, after the first few of the paper sheets had been discharged, water droplets started to adhere to the rest of the paper sheets being discharged. Furthermore, dew condensation was generated across the entire area of the third conveying guide 62 in the longitudinal direction.

The present invention can be used in an image forming apparatus including a fixing device and using the electrophotographic method, such as a copy machine, a printer, a facsimile, or a complex machine having functions of these apparatuses. By the use of the present invention, an image forming apparatus can be provided that, in a case of performing continuous printing of small-sized paper sheets, can effectively suppress a temperature increase in a non-paper passing region of a fixing device.

What is claimed is:

1. An image forming apparatus, comprising:

an apparatus main body having an inner side and an outer side;

an image forming portion that forms a toner image on a recording medium;

a fixing device that is disposed on a downstream side of the image forming portion with respect to a conveying direction in which a recording medium is conveyed, that has fixing roller heated by a heating member and a pressing roller brought into press-contact with the fixing roller to form a fixing nip, and that passes it recording medium through the fixing nip to fix unfixed toner borne on the recording medium; and a fan that, when a recording medium having a width smaller than a width of a maximum-width recording medium that can be passed through the fixing nip is passing through the fixing nip, cools a part of an outer peripheral surface of a non-paper passing region on one of the fixing roller and the pressing roller, said one of the fixing and the pressing rollers being disposed in proximity to the apparatus main body outer side and the outer peripheral surface part of said one of the rollers facing the apparatus main body outer side, wherein on a downstream side of the fixing nip with respect to the conveying direction, a conveying guide is provided that supports a surface of a recording medium that has passed through the fixing nip, the surface of the passed-through recording medium facing the apparatus main body inner side, the conveying guide guiding the recording medium to outside of the apparatus, air flow from the fan passes along the outer peripheral surface part of said one of the rollers to be led to a surface of the conveying guide, and an air passage having a first air passing opening positioned on a side of said one of the rollers and a second air passing opening positioned on a side of the conveying guide is formed between said one of the rollers and the conveying guide.

2. The image forming apparatus according to claim 1, wherein the second air passing opening is formed so as to be opposed to substantially a middle portion of the conveying guide in a longitudinal direction.

3. The image forming apparatus according to claim 1, wherein a reversing conveyor unit is provided that turns over a recording medium and conveys the recording medium to the image forming portion, and the fan sucks air outside the apparatus main body via the reversing conveyor unit.

4. The image forming apparatus according to claim 1, wherein the heating member is an induction heating portion that is disposed so as to be opposed to the fixing roller and, using a magnetic flux it generates, heats an induction heat generation layer provided in the fixing roller by induction heating, and said one of the rollers is the pressing roller.

5. An image forming apparatus, comprising:

an apparatus main body having an inner side and an outer side;

an image forming portion that forms a toner image on a recording medium;

a fixing device that is disposed on a downstream side of the image forming portion with respect to a conveying direction in which a recording medium is conveyed, that has a fixing roller heated by a heating member and a pressing roller brought into press-contact with the fixing roller to form a fixing nip, and that passes a recording medium through the fixing nip to fix unfixed toner borne on the recording medium; and a fan that, when a recording medium having a width smaller than a width of a maximum-width recording medium that can be passed through the fixing nip is passed through the fixing nip, cools a part of an outer peripheral surface of a non-paper passing region on one of the fixing roller and the pressing roller, said one of the fixing and the pressing rollers being disposed in proximity to the apparatus main body outer side and the outer peripheral surface part of said one of the rollers facing the apparatus main body outer side, wherein in a case where image formation is performed using the maximum-width recording medium that can be passed through the fixing nip, the fan is made to rotate so as to have an air volume reduced compared with a case of using a recording medium having a width smaller than the width of the maximum-width recording medium.

6. The image forming apparatus according to claim 5, wherein in the case where image formation is performed using the maximum-width recording medium that can be passed through the fixing nip, after a lapse of a given time period, rotation of the fan is stopped even if image formation is continued, and in the case of using a recording medium having a width smaller than the width of the maximum-width recording medium, the fan is made to rotate continuously until image formation ends.

7. The image forming apparatus according to claim 5, wherein on a downstream side of the fixing nip with respect to the conveying direction, a conveying guide is provided that supports a surface of a recording medium that has passed through the fixing nip, the surface of the passed-through recording medium facing the apparatus main body inner side, the conveying guide guiding the recording medium to outside of the apparatus, and air flow from the fan passes along the outer peripheral surface part of said one of the rollers to be led to a surface of the conveying guide.

8. The image forming apparatus according to claim 5, wherein a reversing conveyor unit is provided that turns over a recording medium and conveys the recording medium to the image forming portion, and the fan sucks air outside the apparatus main body via the reversing conveyor unit.

9. The image forming apparatus according to claim 5, wherein the heating member is an induction heating portion that is disposed so as to be opposed to the fixing roller and, using a magnetic flux it generates, heats an induction heat generation layer provided in the fixing roller by induction heating, and said one of the rollers is the pressing roller.

10. An image forming apparatus, comprising:

an apparatus main body having an inner side and an outer side;

an image forming portion that forms a toner image on a recording medium;

a fixing device that is disposed on a downstream side of the image forming portion with respect to a conveying direction in which a recording medium is conveyed, that has a fixing roller heated by a heating member and a pressing roller brought into press-contact with the fixing roller to form a fixing nip, and that passes a recording medium through the fixing nip to fix unfixed toner borne on the recording medium; and a fan that, when a recording medium having a width smaller than a width of a maximum-width recording medium that can be passed through the fixing nip is passed through the fixing nip, cools a part of an outer peripheral surface of a non-paper passing region on one of the fixing roller and the pressing roller, said one of the fixing and the pressing rollers being disposed in proximity to the apparatus main body outer side and the outer peripheral surface part of said one of the rollers facing the apparatus main body outer side, wherein a conveyor unit is provided that conveys a recording medium toward the fixing device, and the fan sucks air inside the apparatus main body via the conveyor unit.

11. The image forming apparatus according to claim 10, wherein the fan comprises a pair of sirocco fans, each sirocco fan being configured with a plurality of blades extending in a radial direction, the blades being rotated to cause air sucked from a center portion of each sirocco fan to be blown out through a blow-out port provided at an outer peripheral portion of the fan along an outer peripheral edge.

12. The image forming apparatus according to claim 10, wherein on a downstream side of the fixing nip with respect to the conveying direction, a conveying guide is provided that supports a surface of a recording medium that has passed through the fixing nip, the surface of the passed-through recording medium facing the apparatus main body inner side, the conveying guide guiding the recording medium to outside of the apparatus, and air flow from the fan passes along the outer peripheral surface part of said one of the rollers to be led to a surface of the conveying guide.

13. The image forming apparatus according to claim 10, wherein a reversing conveyor unit is provided that turns over a recording medium and conveys the recording medium to the image forming portion, and the fan sucks air outside the apparatus main body via the reversing conveyor unit.

14. The image forming apparatus according to claim 10, wherein the heating member is an induction heating portion that is disposed so as to be opposed to the fixing roller and, using a magnetic flux it generates, heats an induction heat generation layer provided in the fixing roller by induction heating, and said one of the rollers is the pressing roller.

15. An image forming apparatus, comprising:

an apparatus main body having an inner side and an outer side;

an image forming portion that forms a toner image on a recording medium;

a fixing device that is disposed on a downstream side of the image forming portion with respect to a conveying direction in which a recording medium is conveyed, that has a fixing roller heated by a heating member and a pressing roller brought into press-contact with the fixing roller to form a fixing nip, and that passes a recording medium through the fixing nip to fix unfixed toner borne on the recording medium; and a fan that, when a recording medium having a width smaller than a width of a maximum-width recording medium that can be passed through the fixing nip is passed through the fixing nip, cools a part of an outer peripheral surface of a non-paper passing region on one of the fixing roller and the pressing roller, said one of the fixing and the pressing rollers being disposed in proximity to the apparatus main body outer side and the outer peripheral surface part of said one of the rollers facing the apparatus main body outer side, wherein the fan comprises a pair of sirocco fans, each sirocco fan being configured with a plurality of blades extending in a radial direction, the blades being rotated to cause air sucked from a center portion of each sirocco fan to be blown out through a blow-out port provided at an outer peripheral portion of the fan along an outer peripheral edge, two air guiding paths further are provided that establish communication between the blow-out port of each of the sirocco fans and each non-paper passing region, and the sirocco fans are designed to blow out air in the same direction through the blow-out ports, respectively, and are mounted to the conveyor unit so that the blow-out port of one of the sirocco fans is displaced by a predetermined angle with respect to the blow-out port of the other of the sirocco fans, and thus communicating portions of the two air guiding paths have substantially the same length.

16. The image forming apparatus according to claim 15, wherein on a downstream side of the fixing nip with respect to the conveying direction, a conveying guide is provided that supports a surface of a recording medium that has passed through the fixing nip, the surface of the passed-through recording medium facing the apparatus main body inner side, the conveying guide guiding the recording medium to outside of the apparatus, and air flow from the fan passes along the outer peripheral surface part of said one of the rollers to be led to a surface of the conveying guide.

17. The image forming apparatus according to claim 15, wherein the heating member is an induction heating portion that is disposed so as to be opposed to the fixing roller and, using a magnetic flux it generates, heats an induction heat generation layer provided in the fixing roller by induction heating, and said one of the rollers is the pressing roller.

* * * * *